United States Patent [19]

Pedersen

[11] 4,070,799

[45] Jan. 31, 1978

[54] REINFORCED FINGER SEAL FOR SHOT BLAST CABINETS AND THE LIKE

[75] Inventor: John A. Pedersen, Burlington, Canada

[73] Assignee: Wheelabrator-Frye Inc., Hampton, N.H.

[21] Appl. No.: 775,893

[22] Filed: Mar. 9, 1977

[51] Int. Cl.[2] ..... B24C 3/10

[52] U.S. Cl. ..... 51/426; 134/200

[58] Field of Search ..... 51/424, 425, 426; 241/37.5; 134/72, 131, 200

[56] References Cited

U.S. PATENT DOCUMENTS

| | | | |
|---|---|---|---|
| 2,933,802 | 4/1960 | Fuchs | 51/426 X |
| 3,034,262 | 5/1962 | Pawlson | 51/424 |
| 3,788,010 | 1/1974 | Goff | 51/425 |
| 3,822,029 | 7/1974 | Butsch | 134/200 X |

FOREIGN PATENT DOCUMENTS

| | | | |
|---|---|---|---|
| 1,195,464 | 6/1970 | United Kingdom | 51/426 |

*Primary Examiner*—Gary L. Smith
*Attorney, Agent, or Firm*—McDougall, Hersh & Scott

[57] ABSTRACT

A finger seal is disclosed for use in conjunction with shot blasting operations. The seal is formed of polyurethane or similar materials which are resistant to wear from shot blasting. The seals are provided with a plurality of longitudinal reinforcing ribs to increase their strength and effectiveness in preventing the escape of shot from an enclosure.

5 Claims, 4 Drawing Figures

REINFORCED FINGER SEAL FOR SHOT BLAST CABINETS AND THE LIKE

BACKGROUND OF THE INVENTION

This invention relates to the field of equipment for particulate treatment of surfaces. More specifically, it relates to the field of equipment for subjecting parts to sand blast, shot blast or similar blasting operations to effect cleaning, preening, or similar surface treatments. Typically, precision cast parts are subjected to a shot blast to remove burrs and casting imperfections. Such operations are accomplished in an enclosed chamber into which the shot is thrown at high velocity by centrifugal throwing wheels or air pressure. In order to treat a large number of such articles, it is desirable to have the blast treatment process be a continuous one to avoid the necessity for frequently loading and unloading the blast cabinet. To that end finger seals have been developed which permit the entry and exit of parts from a blast cabinet on a continuous basis while at the same time substantially preventing the particulate from escaping the cabinet and potentially injuring a worker.

Finger seals of the type herein disclosed are of a flexible construction and are secured over an opening to the blast cabinet. By using a plurality of such seals the entire opening can be covered. The seals are secured at their top and parts pass by the free lower end by slightly displacing it. The lower end then returns to its initial position to reform a curtain for effectively sealing the cabinet against the escape of particulate.

A problem often encountered with such seals is that they are subject to wear from the blast treatment process and must be frequently replaced. Another problem is that they must be made of sufficiently lightweight and flexible material that the parts to be treated can pass through the seals yet they must be sufficiently stiff so as to maintain an effective closure of the blast chamber opening. As will be observed, these requirements are somewhat contradictory and previous finger seal constructions had not been entirely satisfactory.

It is accordingly an object of the present invention to provide an improved finger seal which is both flexible and wear resistant to blast treatment.

It is another object of the invention to provide an improved finger seal which is formed of polyurethane material and includes a reinforced rib construction so that it is flexible yet strong.

Other objects and advantages of the invention will be apparent from the remaining portion of the specification.

DETAILED DESCRIPTION

Figure 1:
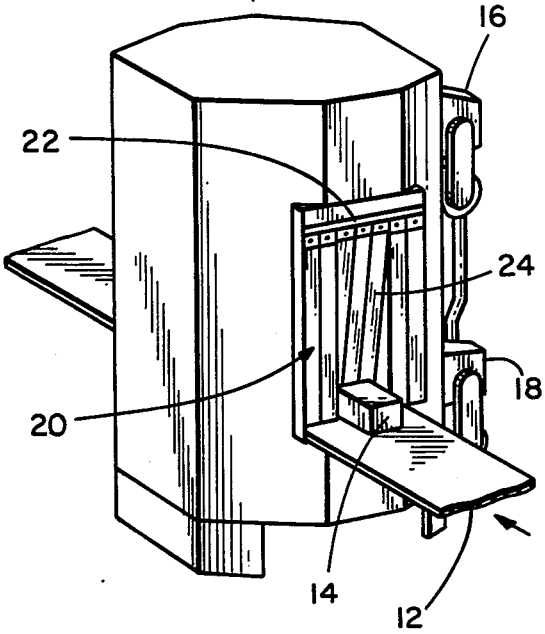
FIG. 1 is a perspective view of a blast cabinet having a plurality of finger seals according to the invention disposed over an opening thereof.
Figure 4:
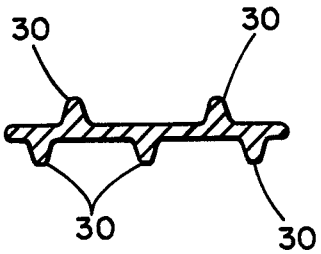
FIG. 4 is a top sectional view along the lines 4—4 of FIG. 2.

Referring now to the drawings, the finger seals according to the invention are illustrated. In FIG. 1 a typical blast cleaning cabinet 10 is illustrated. A conveyor belt 12 is utilized for carrying parts 14 into the cabinet 10 for treatment and then on to additional work stations. One or more blast wheels, such as, wheels 16 and 18, are mounted to the cabinet for projecting particulate, such as, steel shot, sand or steel grit, at the parts 14 at high velocity. The shot blasting is effective for cleaning or otherwise treating the parts. Depending upon the type of installation the spent shot is often collected and recycled for further use. The finger seals according to the invention are secured over the openings 20 through which the parts enter and leave the blast cabinet. It will be recognized that while the finger seals will be described in this specification with respect to blast cabinet 10 the seals have application in other devices where blast treatment is required. In the illustration of FIG. 1 a plurality of finger seals are secured to a frame 22 by means of a bolt 24 which passes through an opening in the seal provided therefor and is secured into the frame 22.

Figure 3:
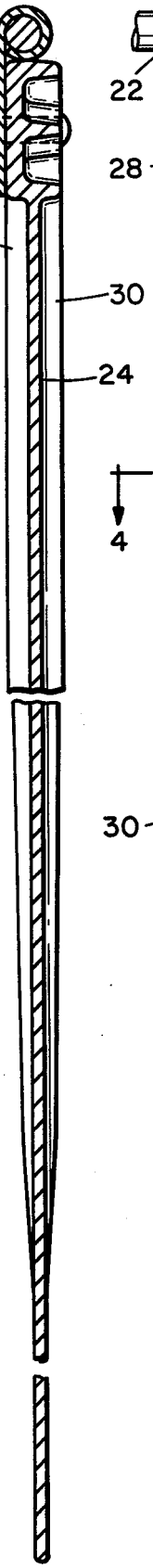
FIG. 3 is a side sectional view along the lines 3—3 of FIG. 2.
Figure 2:
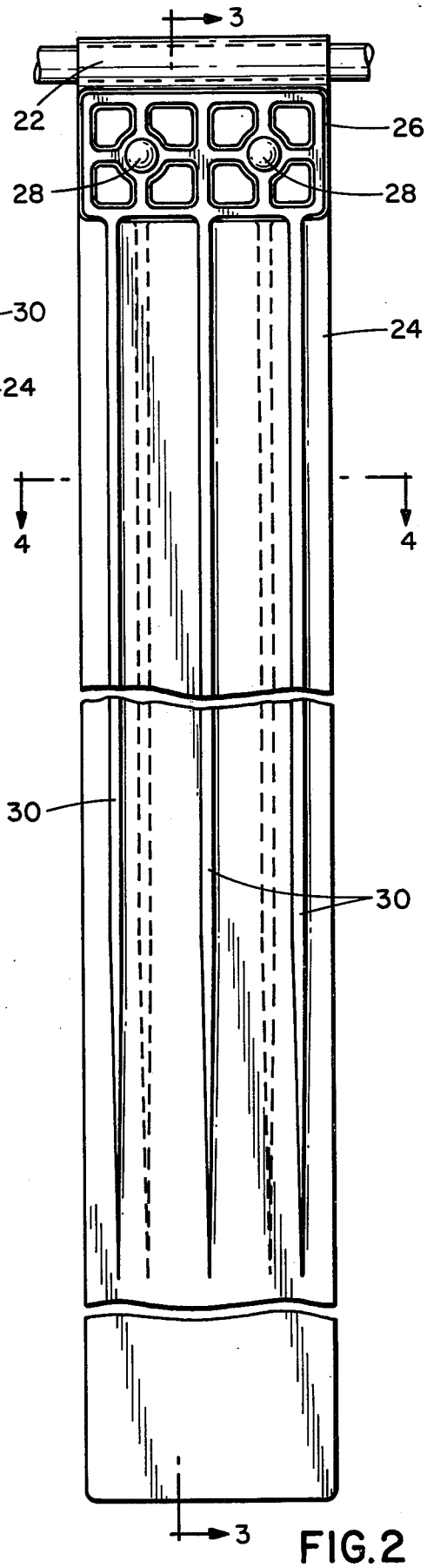
FIG. 2 is a front elevation view of the finger seals according to the invention.

Referring to FIGS. 2 and 3, the construction details of the finger seal are illustrated. The seal is preferably formed as an elongated rectangle although other shapes and dimensional variations are acceptable and within the scope of the invention. The finger seal 24 has a mounting portion 26 which is reinforced to withstand the pressure of being secured by a bolt passing through openings 28. The remaining portion of the seal is provided with a plurality of raised longitudinal reinforcing ribs 30. The ribs are spaced over the surface of the seal on both sides thereof. As can be seen in FIG. 3, the reinforcing ribs taper down and terminate short of the bottom of the finger seals since the amount of reinforcement required varies as a function of the distance from the top of the seal. That is, the seal must be relatively stiff near the top to resist movement from the shot blast and relatively flexible near the bottom to permit entry of the parts into the cabinet.

The seal is preferably formed of polyurethane plastic and is a one piece molded element. Polyurethane is a desirable material in that it has good qualities for the application here involved. It is sufficiently resilient that particulate impinging upon it does not readily wear the surface since the energy of the particulate is absorbed by the seal. Similarly, the polyurethane is stiff enough to maintain its original shape and, therefore, its proper position over the opening to a blast cabinet. The reinforcing ribs 30 add additional strength and stiffness as required for a given application and, accordingly, the number and spacing of the ribs will depend upon the length of the finger seal, degree of flexibility required and similar considerations.

In operation the use of the finger seals will be readily apparent. A plurality of them are secured across an opening, such as opening 20 in FIG. 1. When no part is present on conveyor 12 the seals prevent the escape of particulate from the cabinet 10. A part on the conveyor displaces the finger seals 24 when it reaches the opening and thereby enters the blast cabinet. Due to the resiliency of the polyurethane the seals return to their sealing position as soon as the part has passed into the blast cabinet thus minimizing any escape of particulate should the blast wheels be operating at the time parts are entering and leaving the cabinet. A similar set of seals is provided for the exit opening from the cabinet and in this manner a continuous blast treatment operation can be obtained.

As compared to previous types of finger seals the present invention has certain definite advantages. Such seals have been made in the past from spring steel or other materials. These seals wear excessively due to the abrasive atmosphere in which they are utilized and must be replaced frequently. Rubber seals have also been utilized for blast cabinets and are similarly unsatisfactory in that the desired rigidity has been difficult to obtain and its resistance to shot blasting is not as great. A typical example of a finger seal made according to the invention is 36 inches in length, 4 inches in width, has approximately five reinforcing ribs thereon and weighs approximately 22 ounces. Such a finger seal is preferably pressure molded as a one piece element.

While I have shown and described embodiments of this invention in some detail, it will be understood that this description and illustrations are offered merely by way of example, and that the invention is to be limited in scope only by the appended claims.

I claim:

1. A finger seal for use in preventing the escape of particulate through an opening in a blast treatment device comprising:

a. a reinforced mounting portion adapted to receive a bolt therethrough for securing said seal over said opening, b. an elongated body portion extending downwardly from said mounting portion, the length of said body portion being selected to substantially cover the vertical height of said opening, the width of said body portion being less than said length, c. a plurality of raised reinforcing ribs provided on at least one side of said body portion along the length dimension thereof, each of said ribs spaced from and running parallel to the remaining ribs, said ribs tapering down and terminating at a point in proximity to the bottom of said body portion, whereby said seal is relatively rigid along the upper and middle body portion due to the raised ribs thereby to deflect particulate and is relatively flexible along the lower body portion due to the termination of the ribs thereby to permit entry of parts into said blast treatment device.

2. The device according to claim 1 wherein said finger seal is a one piece molded unit.

3. The device according to claim 1 wherein said finger seal is formed from polyurethane to minimize wear from particulate impinging on the body portion of said seal.

4. The device according to claim 1 wherein at least two raised reinforcing ribs are provided on each side of said body portion.

5. The device according to claim 4 wherein the ribs on one side of said body portion are displaced transversely with respect to said ribs on the other side of said body portion.

* * * * *